US006222140B1

(12) United States Patent
Bachschmid

(10) Patent No.: US 6,222,140 B1
(45) Date of Patent: Apr. 24, 2001

(54) MINIATURE MOMENTARY CONTACT SLIDING SWITCH

(75) Inventor: David E. Bachschmid, Leesburg, VA (US)

(73) Assignee: BP Holdings, LLC, Middleburg, VA (US)

( * ) Notice: Subject to any disclaimer, the term of this patent is extended or adjusted under 35 U.S.C. 154(b) by 0 days.

(21) Appl. No.: 09/528,099

(22) Filed: Mar. 17, 2000

Related U.S. Application Data

(63) Continuation of application No. 09/158,796, filed on Sep. 23, 1998, now Pat. No. 6,091,037, which is a continuation of application No. 09/122,721, filed on Jul. 27, 1998, which is a division of application No. 08/898,958, filed on Jul. 23, 1997, now Pat. No. 5,871,086, said application No. 09/158,796, is a continuation of application No. 08/685,609, filed on Jul. 24, 1996, now abandoned.

(51) Int. Cl.[7] ..... H01H 9/26
(52) U.S. Cl. ..... 200/18; 200/50.32; 200/332.1
(58) Field of Search ..... 200/18, 330, 332.1, 200/338, 50.32, 50.36; 174/66, 67; 220/241, 242

(56) References Cited

U.S. PATENT DOCUMENTS

| | | | |
|---|---|---|---|
| 1,575,469 | 3/1926 | Waterbury . | |
| 2,521,561 | 9/1950 | Batcheller | 200/519 X |
| 2,802,074 | 8/1957 | Pass . | |
| 2,811,700 | 10/1957 | Kuch . | |
| 3,171,920 | 3/1965 | Klein et al. . | |
| 3,217,112 | 11/1965 | Campbell et al. . | |
| 3,470,339 | 9/1969 | Roman . | |
| 3,739,126 | 6/1973 | Sahrbacker et al. . | |
| 3,757,062 | 9/1973 | Lipschutz . | |
| 3,787,653 | 1/1974 | Maher . | |
| 3,839,615 | 10/1974 | Bradford . | |
| 4,017,699 | 4/1977 | Hellman . | |
| 4,180,712 | 12/1979 | Lutzenberger et al. . | |
| 4,181,838 * | 1/1980 | Neuser et al. | 200/330 X |
| 4,324,958 | 4/1982 | Valleau . | |
| 4,331,844 | 5/1982 | Saitoh . | |
| 4,429,201 | 1/1984 | Dekkers et al. . | |
| 4,523,065 | 6/1985 | Heggelund | 200/509 |
| 4,704,503 | 11/1987 | Takasawa . | |
| 5,164,694 | 11/1992 | DeVault et al. . | |
| 5,241,427 * | 8/1993 | Lin | 360/1 |
| 5,914,826 | 6/1999 | Smallwood | 360/12 |

* cited by examiner

*Primary Examiner*—Renee Luebke
(74) *Attorney, Agent, or Firm*—McGuireWoods LLP

(57) ABSTRACT

A sliding plate engages moveable structure such as the actuating lever of an existing wall switch and separates or connects contacts to provide a momentary contact function in a potentially very thin but robust and economical switch suitable for inclusion within a switch plate cover. Momentary contact is provided at an intermediate location between extreme positions of the actuating lever of the existing switch or other moveable structure. Additional contacts can be provided to alter switch function and/or allow discrimination of direction of movement at an intermediate location. The switch can be retrofit to any existing structure without modification of that structure or disturbance of wiring to which that structure is connected.

1 Claim, 6 Drawing Sheets

MINIATURE MOMENTARY CONTACT SLIDING SWITCH

This is a continuation application of U.S. application Ser. No. 09/158,796 filed on Sep. 23, 1998 and now U.S. Pat. No. 6,091,037 which is a divisional application of application Ser. No. 08/898,958 filed on Jul. 23, 1997, and now allowed as U.S. Pat. No. 5,871,086. U.S. application Ser. No. 09/158,796 is also a continuing application of U.S. patent application Ser. No. 09/122,721 filed Jul. 27, 1998 which is a continuation application of U.S. patent application Ser. No. 08/685,609 filed on Jul. 24, 1996, now abandoned.

BACKGROUND OF THE INVENTION

1. Field of the Invention

The present invention generally relates to switches for electronic and electrical apparatus and, more particularly, to miniature switches which are suitable for retrofitting electrical and electronic apparatus to other devices and controlling the electrical or electronic apparatus in conjunction therewith.

2. Description of the Prior Art

Control must be exercised over virtually all electronic or electrical apparatus in order to derive desired functions therefrom. To exercise such control, some device must provide an interface between the apparatus and some external agency such as a condition sensor or, much more often, a human operator. It is sometimes the case that control of a device will be desired in conjunction with operation or control of some other apparatus or system with which the device otherwise cooperates only minimally, if at all. In such a case, either operation or the control of the other apparatus or system must be sensed and converted to an electrical signal suitable for exercising the desired control of the device.

For example, it is known to sense current in one circuit and to control application of power to the another circuit. Thus, as applied in a commercially available power strip to an installation of a personal computer or audio system, the usually accessible power connection to, say, the monitor or the printer of a personal computer or the pre-amplifier, tuner or other component of an audio system, may be used to remotely control application of power to other components of the system where the individual switches therefor are not necessarily accessible or where the convenience of a single power switch for all system components is desired.

In other arrangements which involve separated but similar power sources such as in multi-pole circuit breakers or switches, a simple mechanical interlock between similar switch structures may be sufficient to commonly control separate circuits. In contrast, complex proximity sensing circuits (e.g. capacitive or radiant energy sensors) or signals representing changes in any of a number of different control functions of a device may be used in conjunction with knobs or keypads to provide an additional control function for the same or another device. For example, in some consumer electronics devices such as a car radio, adjustment of any control (e.g. volume) will cause temporary display of alternative data (e.g. tuner frequency rather than time) on a display. However, unless some structural or functional similarity or cooperation can be exploited, auxiliary switching or sensor arrangements are generally bulky, complicated, expensive and/or difficult to retrofit to existing apparatus or systems.

It has recently been proposed to provide a voice recording device in an electrical wall switch plate, such as is disclosed and claimed in co-pending U.S. patent application Ser. No. 08/685,609, filed Jul. 24, 1996 (now abandoned), of which the present inventor is a joint inventor and which application is hereby fully incorporated by reference as if the text thereof were fully set forth herein. In this combination, it is contemplated that the actuation of the wall switch should cause the playback of an audio message of one or more messages (possibly of a sequence of messages) that may be recorded at will, preferably by recording samples of the message in random access memory or other solid state memories.

Such recordation has been facilitated by recent reductions in cost of relatively large capacity semiconductor memories and integrated circuits capable of conversion of analog signals to digital signals and vice-versa. Thus, it is possible to provide the necessary electronics, including a speaker, microphone and battery power supply within a wall switch plate cover with only a relatively modest increase in the thickness thereof (e.g. about a 7/16 inch overall thickness, increasing thickness over a conventional switch plate generally by less than ¼ inch).

Incidentally, at the current state of design of this device, it is preferred to activate the playback function by a brief signal pulse with automatic reset of the playback circuit when the message playback is complete. Thus the preferred function of sensing actuation of the wall switch differs widely from the function of the wall switch itself or the circuit to which it is connected. Further, it is considered desirable to be able to distinguish between directions of actuation to provide different messages for each wall switch state or to control a sequence of messages. Sensing of circuit conditions may also be complicated by so-called three-way or four-way switch connections which may allow a circuit to be controlled from multiple locations potentially remote from the playback device.

However, providing sensing of operation of a wall switch as desired for this application within a switch plate cover is not trivial. The existing wall switch provides the mounting arrangement for the switch plate and conventional switch plates are designed to be drawn tightly against the body of the wall switch with virtually the entirety of the actuating lever of the wall switch protruding therethrough. Of course, external mechanisms would be unsightly and potentially dangerous.

Current sensing in the controlled circuit is less than fully reliable due to possible variation or disconnection of the load controlled by the switch and, in any event, it is desirable for purposes of simplicity and safety of installation of the device to retrofit it to an existing wiring system without disturbance of existing wiring in any way. Prevailing electrical codes may prohibit and restrict any incursion of any portion of the device or its circuitry into an existing electrical wiring box.

The need for linking of a switch or other structure to an existing electrical switch within a small volume is not limited to the device disclosed in the above-incorporated application. While many arrangements for operationally linking switches and electrical circuits are known, none are suitable for providing sensing of actuation and/or direction of actuation within a small thickness and within a wall switch cover plate with only a marginal increase in thickness thereof. Further, the required thinness of a switch may limit its ability to withstand thousands of actuations of the switch to which is to be connected.

SUMMARY OF THE INVENTION

It is therefore an object of the present invention to provide a very thin but mechanically robust switch and linkage suitable for simple connection to the actuating lever of an existing electrical switch such as a wall switch and without requirement for modification of the existing electrical switch or contact with existing wiring.

It is another object of the invention to provide a momentary contact switch for sensing an intermediate location of an actuating lever of another switch.

It is a further object of the invention to provide a mechanically robust switch and linkage capable of sensing a direction of movement of an actuating lever of another switch at an intermediate location thereof between normal switch actuation positions.

In order to accomplish these and other objects of the invention, a momentary contact switch is provided comprising a support structure, a sliding plate having an aperture to engage an actuating lever of an electrical switch and slidable along a locus relative to the support structure, and an arrangement moveable with the sliding plate to control movement of a first electrical contact against a second electrical contact at a position intermediate between two extreme positions of said sliding plate.

In accordance with another aspect of the invention, a method of retrofitting apparatus such as a voice recording and playback apparatus to an electrical switch is provided comprising the steps of placing an aperture in a plate slidable relative to a support structure over an actuating lever of the electrical switch, attaching the support structure to the electrical switch, controlling movement of electrical contacts with the plate in accordance with the relative position of the plate and the support structure, and controlling the apparatus with said electrical contacts.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
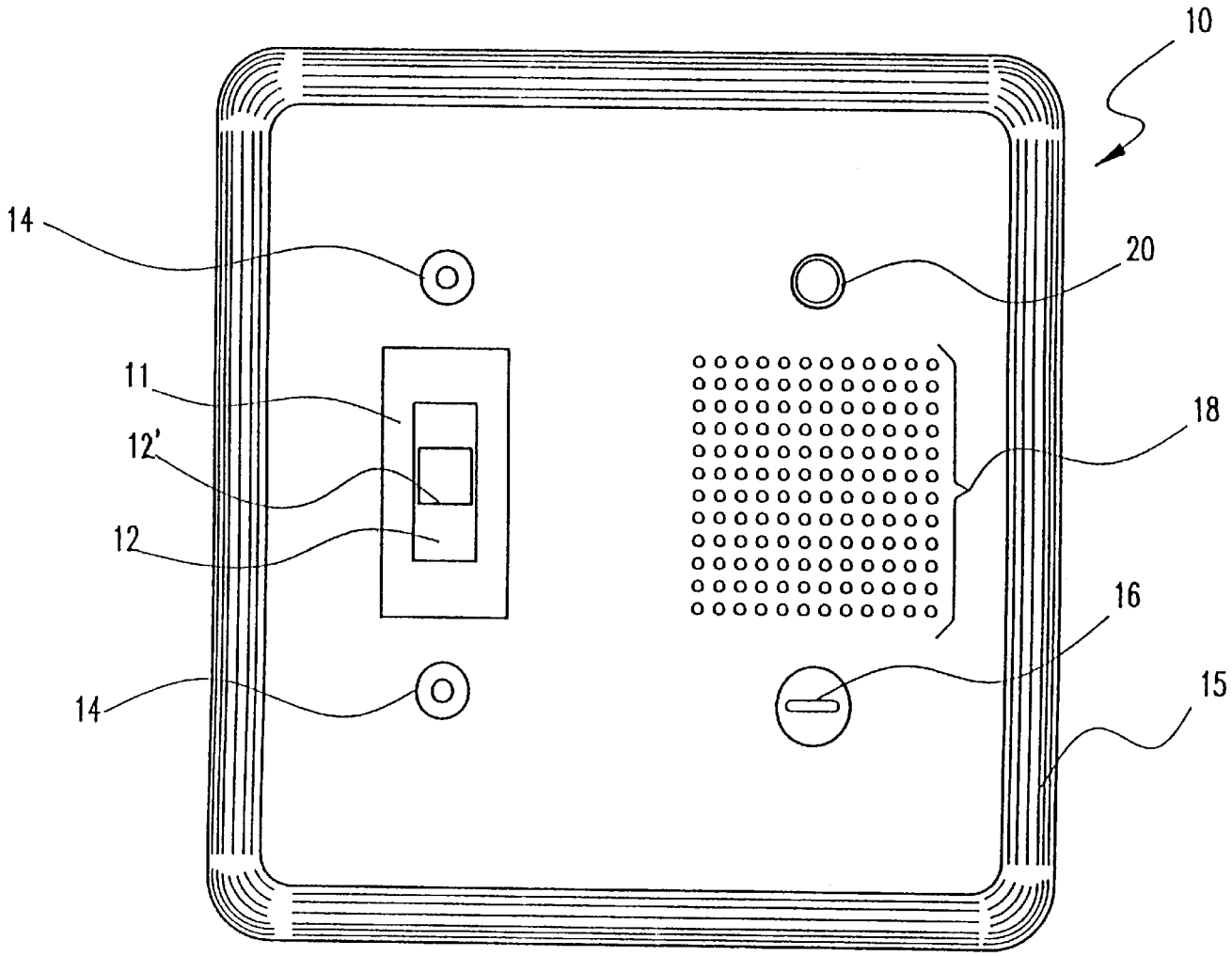
FIG. 1 is a plan view of the front of a wall switch plate including a preferred recording and playback device and a switch in accordance with the invention.

Referring now to the drawings, and more particularly to FIG. 1, there is shown, in plan view, the front of a wall switch cover plate 10 including a voice recorder in accordance with a preferred application of the invention. The switch plate includes an aperture 11, preferably tapered or bevelled about the periphery thereof through which an actuating lever of an existing conventional wall switch (not shown) may protrude, passing through a portion of a sliding plate 12 supported by cover plate 10 with an aperture 12' therein which thus engages the actuating lever of the existing wall switch, schematically illustrated and indicated by the same reference numeral. Apertures 14 are provided for mounting the wall switch cover plate 10 to the existing wall switch in the conventional fashion. To conceal the slightly increased thickness of the cover plate and provide an aesthetically pleasing appearance as well as efficiently housing conventionally shaped batteries therein, the edges thereof are preferably bevelled or rounded as shown at 15 in a manner not at all critical to the practice of the present invention.

An opening 16 is preferably provided to facilitate acoustic coupling to a miniature microphone placed behind it. The opening can be formed in a manner to resemble the head of a mounting screw, as illustrated, if desired. Further apertures 18 are provided as a grille for a miniature speaker which can be mounted behind it and a button 20, which can also be made to resemble a head of a mounting screw, is also provided to control the recording function.

Figure 2A:
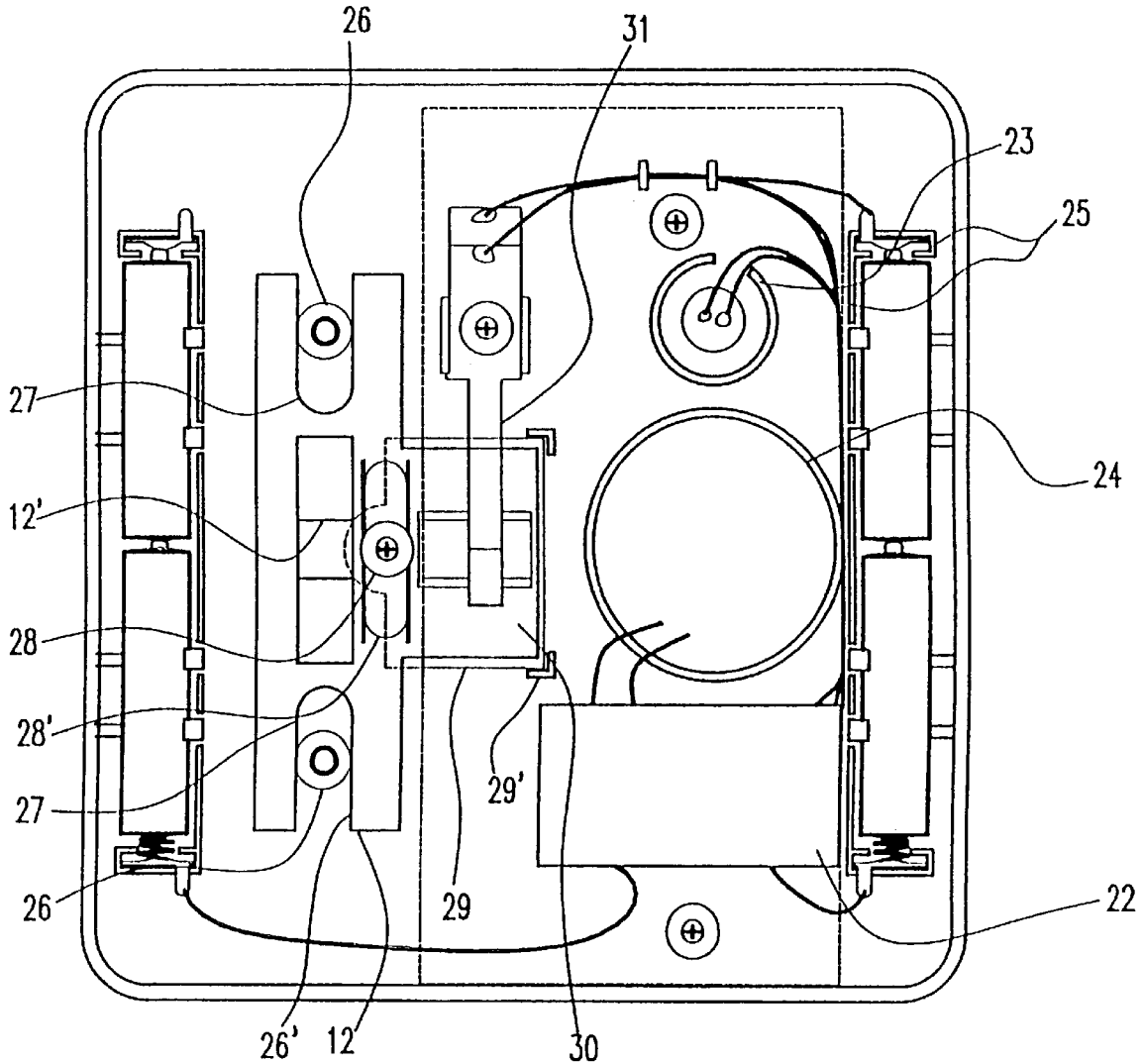
FIG. 2A is a plan view of the back of a wall switch plate including a preferred recording and playback device and a switch in accordance with the invention.

Referring now to FIG. 2A, the back side of the wall switch cover plate 10 is shown in plan view. Mounting arrangements for the electronics board (22), microphone (23), speaker (24) and batteries (25) are preferably provided as molded bosses but are not critical to the practice of the invention. In the same manner, stand-off bosses 26 are provided to accommodate the thickness of sliding plate 12 and to provide bearing surfaces therefor. Accordingly, when the actuating lever of an existing wall switch engages aperture 12' in sliding plate 12, cut-outs 27 bear against bosses 26 to constrain movement of sliding plate 12 along a preferably linear locus. Additionally, the sliding plate 12 is assembled to the cover plate 10 with a screw, washer and insulating bearing washer (all generally indicated at 28) through slot 28'. The insulating washer serves to retain contact plate 29 in position against the cover plate and positioned by preferably molded bosses 29'. It should be understood that that contact plate could also be a fixed contact mounted as part of a switch including moveable contact 31. Electrical connection to contact plate or fixed contact 29 may be made in any desired manner, conveniently in the same direction and under contact 31 as illustrated in FIG. 2A. Alternatively, adhesive or other expedients may be used to attach the contact plate 29 in place.

Figure 2C:
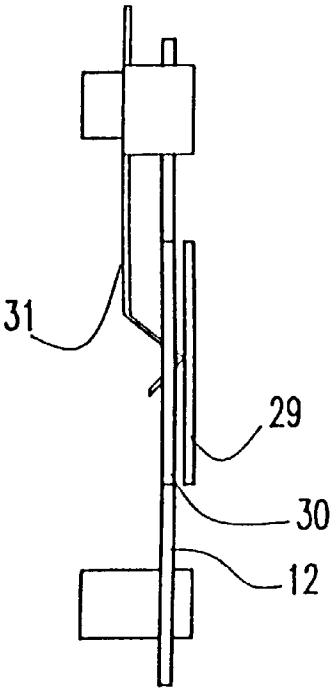
FIGS. 2B and 2C are plan and side views of a preferred form of the switch in accordance with the invention.
Figure 2B:
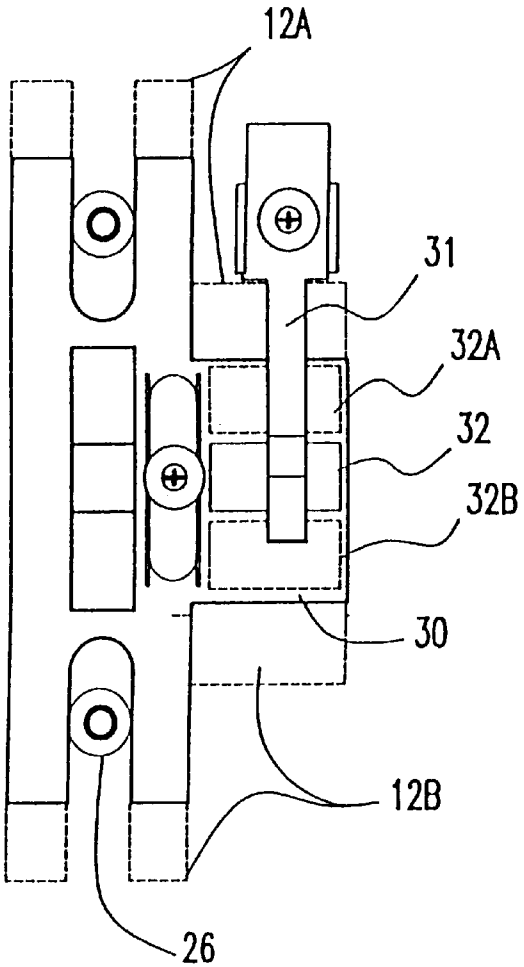

Sliding plate 12 also carries a switch mask portion 30, also shown in FIG. 2B. It should be appreciated that the position of sliding plate 12 depicted in FIG. 2A relative to cover plate 10 (and in FIG. 2B relative to bosses 26) corresponds to an intermediate position of the existing wall switch with which it is intended to cooperate. Therefore, the actuated or operative positions of the existing wall switch bring sliding plate 12 to one of the extreme positions indicated by dashed lines 12A or 12B.

The switch in accordance with the invention is formed by contact plate 29, shown in FIGS. 2A and 2C and a conductive contact 31 shown in all of FIGS. 2A–2C, preferably of a cantilevered form illustrated but not critical to the invention. It should be further appreciated that a further aperture 32 in sliding plate 12 allows contact between contact 31 and contact plate 12 when sliding plate 12 is in the intermediate position between operative positions of the actuating lever of the existing switch. In either of these operative positions of the existing switch, aperture 32 is moved to either position 32A or 32B (corresponding to the extreme positions 12A and 12B, respectively, of the sliding plate 12) and the mask portion 30 of sliding plate 12 thus serves to insulate contact 31 from contact plate 29. Accordingly, as perhaps more clearly shown in FIG. 3, the switch formed by sliding plate 12 and contacts 29 and 31 provides a momentary contact as the actuating lever of the existing switch is moved between operative positions.

Figure 3:
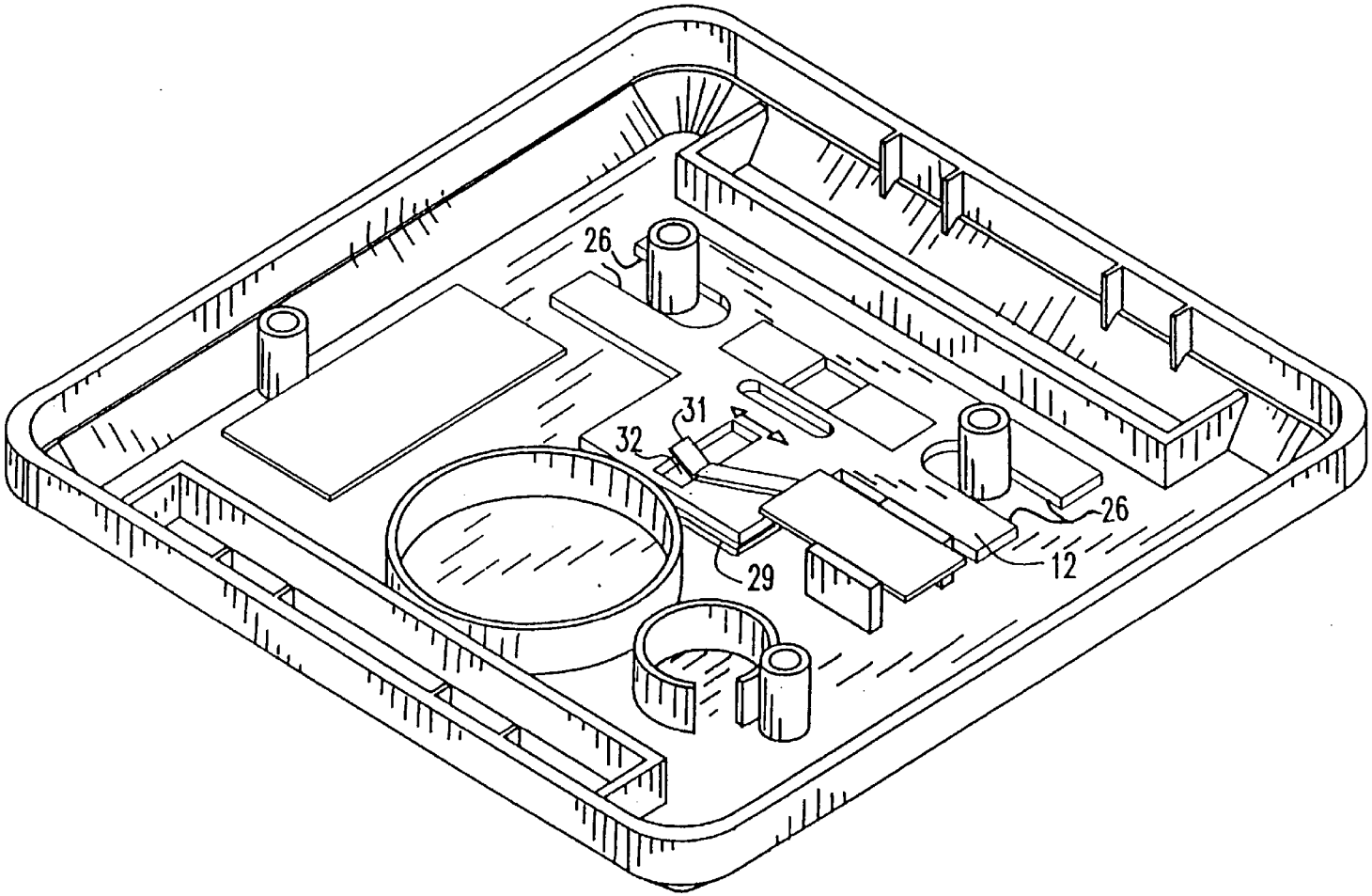
FIG. 3 is a perspective view of a preferred form of the switch and wall plate in accordance with the invention with recording and playback circuits removed.

It should further be appreciated that sliding plate 12 has robust bearing surfaces 26' which bear against bosses 26 and the separation between them is long in comparison with the separation of mask portion 30 from the axis between them. Therefore, the sliding plate mechanism 12 is not susceptible to binding. Likewise, mask portion 30 can bear directly against contact plate 29 and be supported thereby as it is driven between contact 31 and the contact plate 29. The edges of aperture 32 can be bevelled, if desired, to assist in the ease with which contact 31 can be separated from contact plate 29 and preferably works against only the small force exerted by the relatively long cantilever of contact 31 (which is, of course sufficiently long that only elastic deformation of the cantilever will occur over the small thickness of sliding plate 12). Therefore, the switch of FIGS. 1–3 is extremely reliable and robust and need be no thicker than the contact plate 29 (which could, in theory be formed by a foil or a plated layer), the small thickness of sliding plate 12, and enough curvature or other shaping in cantilever 31 to accommodate that small thickness. In essence, the total required thickness of the switch is only twice the thickness of the sliding plate 12 plus the thickness of contact 31. It should be noted in this regard that the relatively wide areas of the mask portion 30 of sliding plate 12 provide a substantial degree of stiffness to resist deformation around the aperture 32 even if sliding plate 12 is very thin and of a relatively flexible material.

From the foregoing, it is seen that the preferred form of the invention provides a mechanically reliable and robust basic momentary contact switch design of minimal thickness which can be refined in many ways by those skilled in the art in view of this description thereof. Bearing surfaces can be provided by readily available insulative and abrasion-resistant materials which will provide a long serviceable lifetime under the extremely light loads inherent in the design are readily available. Additionally, lubrication can be provided and renewed from time to time at bosses 26 and contact plate 29. It should also be noted that the only moving part of the switch other than the slight elastic deformation of the contact 31 is slidable plate 12 which is inexpensive and could be easily renewed since it is held in position over bosses 26 only by a single screw 28.

Figure 4:
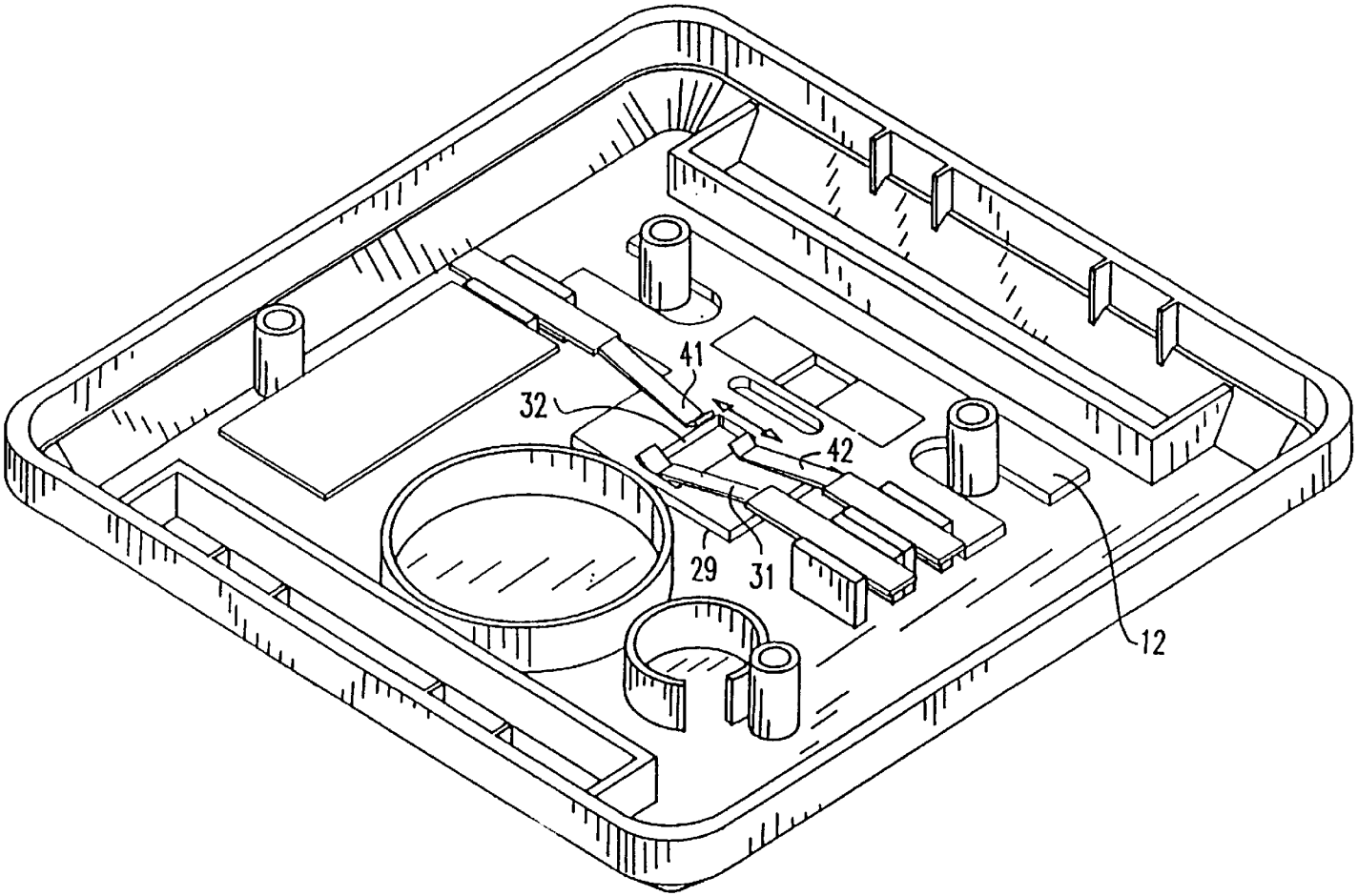
FIG. 4 is a perspective view of a variant form of the switch of FIG. 2A including provision for sensing direction of motion of an actuating lever of a switch to which it is connected.

A preferred variant form of the invention which can provide discrimination of direction of motion of the existing switch actuating lever can best be understood from a comparison of FIG. 4 with the similar view shown in FIG. 3 discussed above. In this variant form of the invention, contact plate 29, contact 31 and aperture 32 in sliding plate 12 are functionally identical to the embodiment of FIG. 3 although the size, form and placement thereof may be varied to accommodate additional contacts 41 and 42.

It will be recalled from the foregoing that the recording and playback device 22 of the preferred application of the invention is arranged to begin operation in response to a momentary pulse and resets itself for another operation when an operation is complete. Therefore, the recording and playback device 22 will not respond to a further pulse during an operation. While the preferred configuration of the variant form of the invention illustrated in FIG. 4 exploits this function of recording and playback device 22 so that only the first of two momentary contacts is recognized, other mechanical configurations or electrical logic circuitry provided to achieve a the same or other desired function.

For example, while the embodiment illustrated in FIG. 4 has contacts 41 and 42 placed such that all of contacts 31, 41 and 42 are separated from contact plate 29 in either extreme position of sliding plate 12, contacts 41 and 42 could be more widely separated to be in contact with contact plate 29 at an extreme position of sliding plate 12 and, for example, a capacitor charging circuit connected to each of contacts 41 and 42 such that a respective capacitor will be discharged through contact 31 as sliding plate 12 moves through the intermediate position and while both contacts 41 and 42 are separated from contact plate 12. Alternatively, only contacts 41 and 42 need be provided in combination with an electrical connection to contact plate 29 to provide an input to a logic circuit which can similarly discriminate which of contacts 41 and 42 contacts contact plate 29 earlier or later than the other.

In this way, only one pulse will be produced for each movement of sliding plate 12 but different directions of movement will produce that pulse at a different node of the circuit and can thus be discriminated. It will be appreciated from the foregoing that other functions could also be achieved by providing additional or differently shaped apertures 32 in mask portion 30 of sliding plate 12 as well as additional switch poles and may be found desirable or convenient.

Referring now to the plan view of the variant form of the invention of FIG. 4 shown in FIG. 5, the direction discriminating function thereof will now be explained. In either extreme position 12A or 12B of sliding plate 12 aperture 32 will be at locations 32A or 32B respectively, at which all contacts 31, 41 and 42 will be separated from the contact plate 29 by the interposition of the mask portion 30 of sliding plate 12. In a central intermediate position, depicted in solid lines, only contact 31 will be in contact with contact plate 29 and contacts 41 and 42 will be separated from the contact plate 29 by the edge of aperture 32.

Between each extreme position 12A, 12B, and the central intermediate position there will be a position indicated by bracket 51 of sliding plate 12 at which two contacts will be allowed to simultaneously be in contact with contact plate 29 while one of contacts 41 and 42 will be separated therefrom by the mask portion 30 of the sliding plate 12. While another such position, indicated by bracket 52, will occur before the opposite extreme position is reached, simultaneous connection of two contacts with or through contact plate 29 will always occur before the other as the existing switch lever is moved between operative positions. Thus, the direction of movement on the existing switch lever can be readily discriminated by detection of the earlier (or later) connection of contact 41 or 42 with contact 32.

As alluded to above, the embodiments of the invention illustrated in FIGS. 3 and 4 rely on elastic deformation of contacts 31, 41, 42, (e.g. by being cantilevered) as they are separated from contact plate 29 by the mask portion 30 of sliding plate 12 such that they will return to their original shape to contact the contact plate 29 when allowed to do so by the aperture 32. While preferred for thinness and economy of manufacture and/or repair, robustness of the switch may be enhanced by providing for positive contact movement and engagement as will now be discussed for different forms of the invention illustrated in FIGS. 6–8. It should be understood, however, that positive contact and increased robustness is achieved at a cost of the positive separation of contacts in the above-described embodiments and may require, in practical implementations, increased stiffness of contacts and consequent increase in actuation force and susceptibility to wear. However, in applications not subject to accelerations such as with a wall switch, maintaining separation may not be a problem and relatively thin resilient contacts may be employed.

Figures 5, 6, 7, 8:
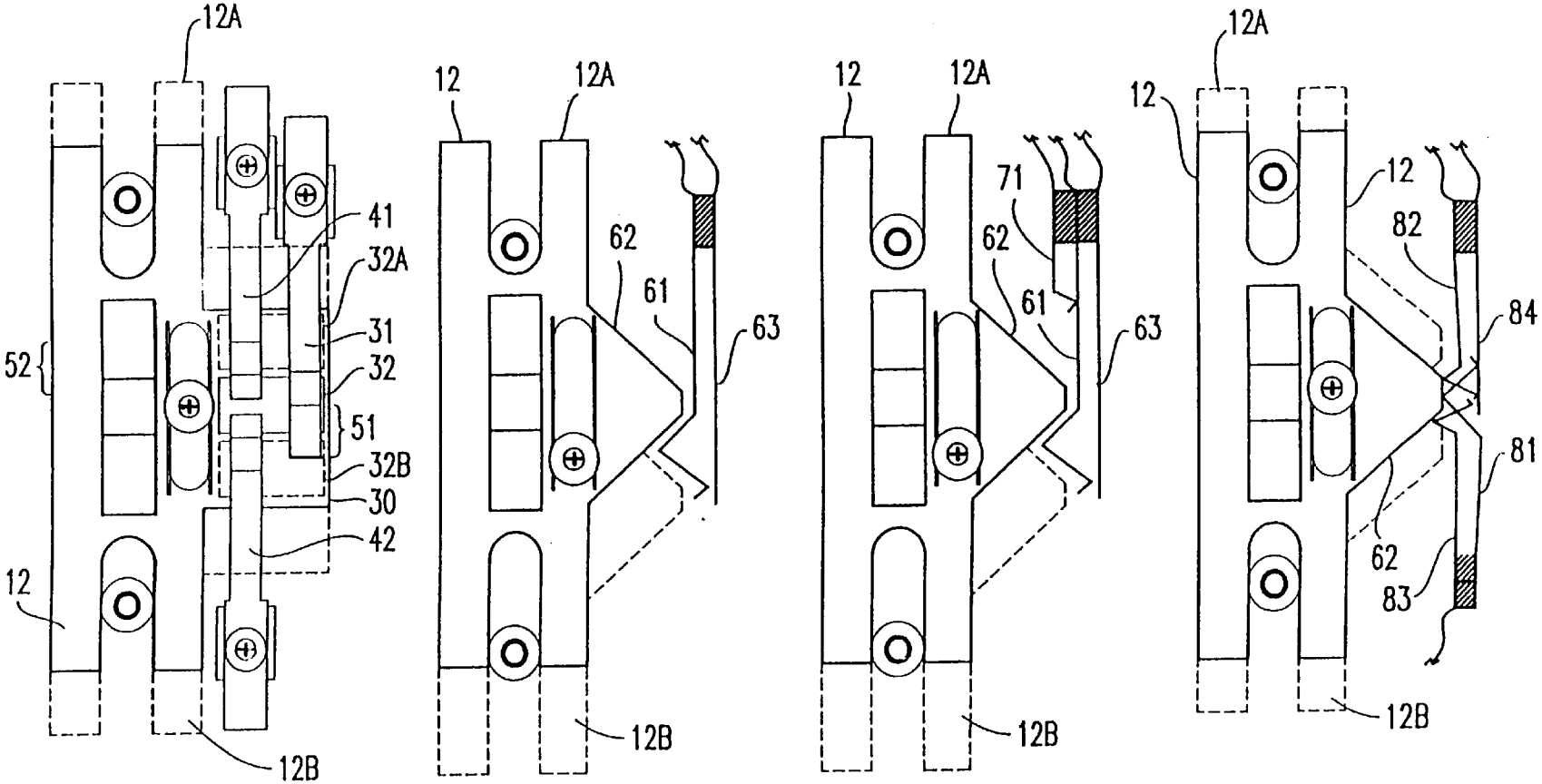
FIG. 5 is a plan view of the variant form of the invention shown in FIG. 4.
FIG. 6 is a plan view of a form of the invention functionally corresponding to FIG. 3 and employing a cam.
FIG. 7 is a plan view of a modified form of the switch of FIG. 6.
FIG. 8 is a plan view of a form of the invention functionally corresponding to FIG. 3 and employing a cam.

Referring first to FIG. 6, an embodiment of the invention having a momentary contact function corresponding to that of the embodiment of FIG. 3 is shown. Essentially, the embodiment of FIG. 6 (and FIGS. 7 and 8, as well) use a cam 62 for providing positive contact instead of an aperture 32 which provides positive separation. Thus, as sliding plate 12 moves from one extreme position 12A, shown in solid lines, to the other extreme position 12B, shown in dashed lines, cam 62 will be brought into contact with contact 61 and urge it against contact 63 which functions in the same manner as contact plate 29 of the embodiment of FIGS. 3 and 4.

Similarly in FIG. 7, cam 62 momentarily bears against contact 61 to urge it against contact 63 while separating it from contact 71 as the sliding plate 12 moves between extreme positions 12A and 12B. It should be appreciated that the switch function of simultaneously opening one pair of contacts while closing another is readily achieved with a cam structure. The same function can also be achieved using an aperture 32 as in the embodiments of FIGS. 3 and 4 but may require additional apertures or shaping of the edges of aperture 32 to obtain the desired function, as will be evident to those skilled in the art in view of this description.

The embodiment of the invention shown in FIG. 8 corresponds to the switch function of the variant form of the invention shown in FIG. 4. Specifically, in FIG. 8, sliding plate 12 is shown between an extreme position 12A, 12B, and a central intermediate position at which both contacts 81 (corresponding to contact 31 of FIG. 4) and 82 (corresponding to 41 of FIG. 4) are brought into contact with contact 84 (corresponding to contact plate 29 of FIG. 4). Similarly, in the central intermediate position, only contact 81 will be in contact with contact 84 and in an extreme position, none of contacts 81, 82 or 83 will contact the contact 84. Thus, as in the embodiments of FIGS. 6 and 7, the embodiment of FIG. 8 also provides momentary contact but additionally provides for discrimination of direction of movement in the manner described above in regard to FIG. 4.

It should be understood in regard to the embodiment of the invention illustrated in FIG. 8 that separate contacts 84 can be provided for any desired ones of contacts 81–83 as may be desired and additional contacts corresponding to contact 71 of FIG. 7 may be provided as desired. Additionally, separate cams 62 could be provided for any or all contacts 81–83 in the same manner that the edges of aperture 32 may be adjusted to alter switch functions or plural apertures 32 provided.

It should also be appreciated in regard to the embodiments of FIGS. 6–8 that the location of the cam 62 is not critical to the invention. For example, cam 62 could be provided on the front or back side of sliding plate 12. However, such a location would result in greater switch thickness and may require other structural adjustments such as provision of bearing surfaces, additional stiffness of the sliding plate 12 and the like, as will be apparent to those skilled in the art.

It should also be appreciated that all of the above disclosed embodiments of the invention can accommodate differing amounts of movement of an existing switch actuating lever or other moveable structure by virtue of the momentary contact function at an intermediate location between extreme positions and thus is applicable to a wide variety of switches made by different manufacturers. Any length of movement can be accommodated by design of the length of slots 27 and 28'.

In view of the foregoing, it is seen that the invention provides a plurality of momentary contact switch functions including discrimination of direction of movement at an intermediate position in a robust switch structure which can be very thin and economically manufactured and/or repaired. The switch can be retrofitted to an actuating lever of an existing switch or other moveable structure without modification of the switch or other structure or disturbance of existing wiring to detect operation of, for example, an electrical light controlling circuit and to coordinate operation of another device such as a sound recording and playback device therewith.

While the invention has been described in terms of a single preferred embodiment and variations thereon, those skilled in the art will recognize that the invention can be practiced with modification within the spirit and scope of the appended claims.

Having thus described my invention, what I claim as new and desire to secure by Letters Patent is as follows:

1. A method of retrofitting an apparatus to an electrical switch comprising the steps of placing an aperture in a sliding plate which is slidable relative to a support structure, said aperture being positioned about an actuating lever of said electrical switch, attaching said support structure to said electrical switch, controlling movement of electrical contacts of said apparatus with said sliding plate in accordance with a relative position of said sliding plate and said support structure by sliding said sliding plate along a straight path along a plane of said support structure by moving said actuating lever of said electrical switch, and controlling said apparatus with said electrical contacts.

* * * * *